US009878232B1

(12) United States Patent
Tseng

(10) Patent No.: US 9,878,232 B1
(45) Date of Patent: Jan. 30, 2018

(54) PLAYING CARD GAME MACHINE WITH ANTI-CHEAT DEVICE

(71) Applicant: Tzu-Hsiang Tseng, Taichung (TW)

(72) Inventor: Tzu-Hsiang Tseng, Taichung (TW)

( * ) Notice: Subject to any disclaimer, the term of this patent is extended or adjusted under 35 U.S.C. 154(b) by 0 days.

(21) Appl. No.: 15/256,752

(22) Filed: Sep. 6, 2016

(51) Int. Cl.
*A63F 1/12* (2006.01)

(52) U.S. Cl.
CPC ..... *A63F 1/12* (2013.01); *A63F 2250/58* (2013.01)

(58) Field of Classification Search
CPC ..... A63F 1/12; A63F 1/14
USPC ..... 273/149 R
See application file for complete search history.

(56) References Cited

U.S. PATENT DOCUMENTS 2,178,276 A * 10/1939 Breither ..... G07F 5/02 194/204
3,619,576 A * 11/1971 Cauthen ..... G06M 3/12 139/97
4,327,824 A * 5/1982 Nicholson ..... G07F 1/043 194/203
6,361,044 B1 * 3/2002 Block ..... A63F 1/14 273/148 R
7,374,170 B2 * 5/2008 Grauzer ..... A63F 1/14 273/149 R
7,717,427 B2 * 5/2010 Grauzer ..... A63F 1/14 273/149 P
8,382,566 B2 * 2/2013 Feng ..... A63F 13/12 463/1
8,523,684 B2 * 9/2013 Lutnick ..... G07F 17/3258 273/148 R
8,567,784 B2 * 10/2013 Miller ..... A63F 9/00 273/148 A
8,734,238 B2 * 5/2014 Arnone ..... G07F 17/3241 463/16
8,851,479 B2 * 10/2014 Shigeta ..... A63F 1/10 273/293
8,986,110 B2 * 3/2015 Arnone ..... G07F 17/3241 463/16
9,457,262 B2 * 10/2016 Shigeta ..... A63F 1/10
9,685,037 B2 * 6/2017 Arnone ..... G07F 17/3241
2004/0097285 A1 * 5/2004 Fisher ..... G07F 17/32 463/24
2012/0058814 A1 * 3/2012 Lutnick ..... G07F 17/3258 463/25
2015/0081063 A1 * 3/2015 Shigeta ..... A63F 1/10 700/91

(Continued)

*Primary Examiner* — John E Simms, Jr.
*Assistant Examiner* — Dolores Collins
(74) *Attorney, Agent, or Firm* — Raymond Y. Chan; David and Raymond Patent Firm

(57) ABSTRACT

A playing card game machine with an anti-cheat device includes a shuffling machine and a robotic arm. The shuffling machine includes a drive mechanism to drive a movable board having a through hole to move left and right. The robotic arm is provided with a suction cup. The suction cup passes through the through hole of the movable board to suck playing cards. The movable board is provided with a sensing seat. The periphery of the sensing seat is provided with infrared receivers arranged in at least three directions. The infrared receivers of the sensing seat can sense an external infrared ray and prevent the playing cards from being marked, so that the player is unable to know the suit and numeric of the playing card passing through the through hole to bring a fair competition in the game. An infrared transmitter is provided to achieve a self-check.

4 Claims, 3 Drawing Sheets

(56) References Cited

U.S. PATENT DOCUMENTS

| | | | | |
|---|---|---|---|---|
| 2015/0151191 | A1* | 6/2015 | Shigeta | A63F 1/10<br>273/149 R |
| 2015/0348371 | A1* | 12/2015 | Blazevic | G07F 17/3288<br>463/11 |

* cited by examiner

PLAYING CARD GAME MACHINE WITH ANTI-CHEAT DEVICE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a playing card game machine with an anti-cheat device, and more particularly to a shuffling machine provided with an infrared receiver able to check playing cards which are marked and sensed by an infrared video apparatus, preventing any cheat to bring unfairness in the game.

Description of Related Arts

A conventional playing card game machine, as shown in FIG. 1, comprises a shuffling machine 10 and a robotic arm 20, and is able to prevent the players from touching playing cards. The shuffling machine 10 has a central accommodation trough 11, a left accommodation trough 12, and a right accommodation trough 13. Each accommodation trough is provided with a platform therein. The platform is connected with a lift mechanism to drive the platform up and down. The shuffling machine 10 is provided with a movable board 14. The movable board 14 has a through hole 15, and is movably disposed over the central accommodation trough 11, the left accommodation trough 12, and the right accommodation trough 13 at a predetermined height. The movable board 14 includes a card distribution plate 16 extending downward. A drive mechanism 17 is connected with the movable board 14 to drive the movable board 14 to move left and right. The game machine provides automatic distributing and shuffling functions. The shuffling machine 10 gives playing cards a good shuffle, and then a suction cup 21 of the robotic arm 20 passes through the through hole 15 of the movable board 14 to suck the playing cards. During the game, the playing cards are totally operated mechanically, without any manual operation so as to prevent any cheat. However, when the playing cards are placed into the shuffling machine 10 or the playing card are replaced with new ones, people will touch the playing cards and the playing cards may be marked with an infrared reflection material. The banker or the player can know the suit and numeric of the marked playing cards through an infrared transmitting apparatus (such as an infrared video camera). As a result, the game is unfair, and the players have less will to participate the game. Accordingly, the inventor of the present invention has devoted himself based on his many years of practical experiences to solve this problem.

SUMMARY OF THE PRESENT INVENTION

The primary object of the present invention is to solve the foregoing problems and to provide a playing card game machine with an anti-cheat device. A movable board of a shuffling machine is provided with an infrared receiver, preventing playing cards sucked by a robotic arm and passing through a through hole of the movable board from being marked and sensed by an external video apparatus.

In order to achieve the aforesaid object, the playing card game machine with an anti-cheat device of the present invention comprises a shuffling machine and a robotic arm. The shuffling machine comprises a drive mechanism to drive a movable board having a through hole to move left and right. The robotic arm is provided with a suction cup. The suction cup passes through the through hole of the movable board to suck playing cards. The movable board is provided with a sensing seat. The periphery of the sensing seat is provided with infrared receivers arranged in at least three directions.

In an embodiment of the present invention, the through hole corresponds in shape to the playing cards. A front end of the movable board is formed with a U-shaped frame. The sensing seat has a U shape corresponding to the U-shaped frame. The periphery of the sensing seat has a front side, a left side, and a right side. Each of the front side, the left side and the right side has at least one accommodation cavity. The accommodation cavity is provided with one of the infrared receivers therein.

In an embodiment of the present invention, a distal end of the robotic arm has a coupling seat. The coupling seat has a first extension plate and a second extension plate. The first extension plate is provided with the suction cup. The second extension plate is provided with an infrared transmitter. The infrared transmitter projects infrared rays to the infrared receivers of the sensing seat.

In an embodiment of the present invention, the accommodation cavity is a trumpet-shaped opening.

Through the aforesaid device, the infrared receivers of the sensing seat can sense an external infrared ray and stop running of the game machine and send a warning signal. This prevents the playing cards from being marked, and the player is unable to know the suit and numeric of the playing card passing through the through hole to bring a fair competition in the game. The infrared transmitter of the coupling seat projects infrared rays to the infrared receivers of the sensing seat, achieving a self-check to confirm whether the running of the game machine is normal.

DETAILED DESCRIPTION OF THE PREFERRED EMBODIMENT

Embodiments of the present invention will now be described, by way of example only, with reference to the accompanying drawings.

Figure 1:
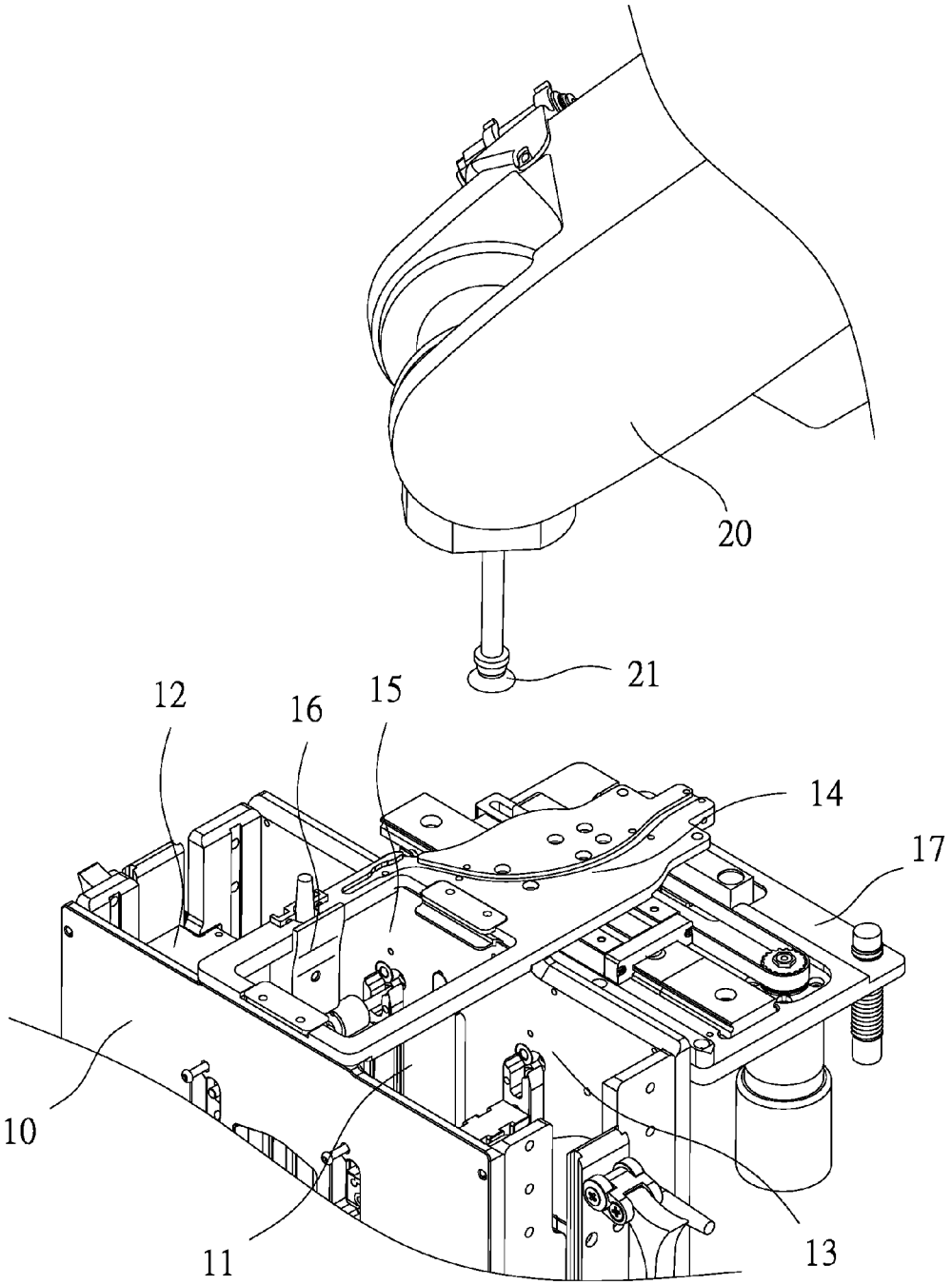
FIG.1 PRIOR ART
FIG. 1 is a perspective view of a conventional game machine.
Figure 2:
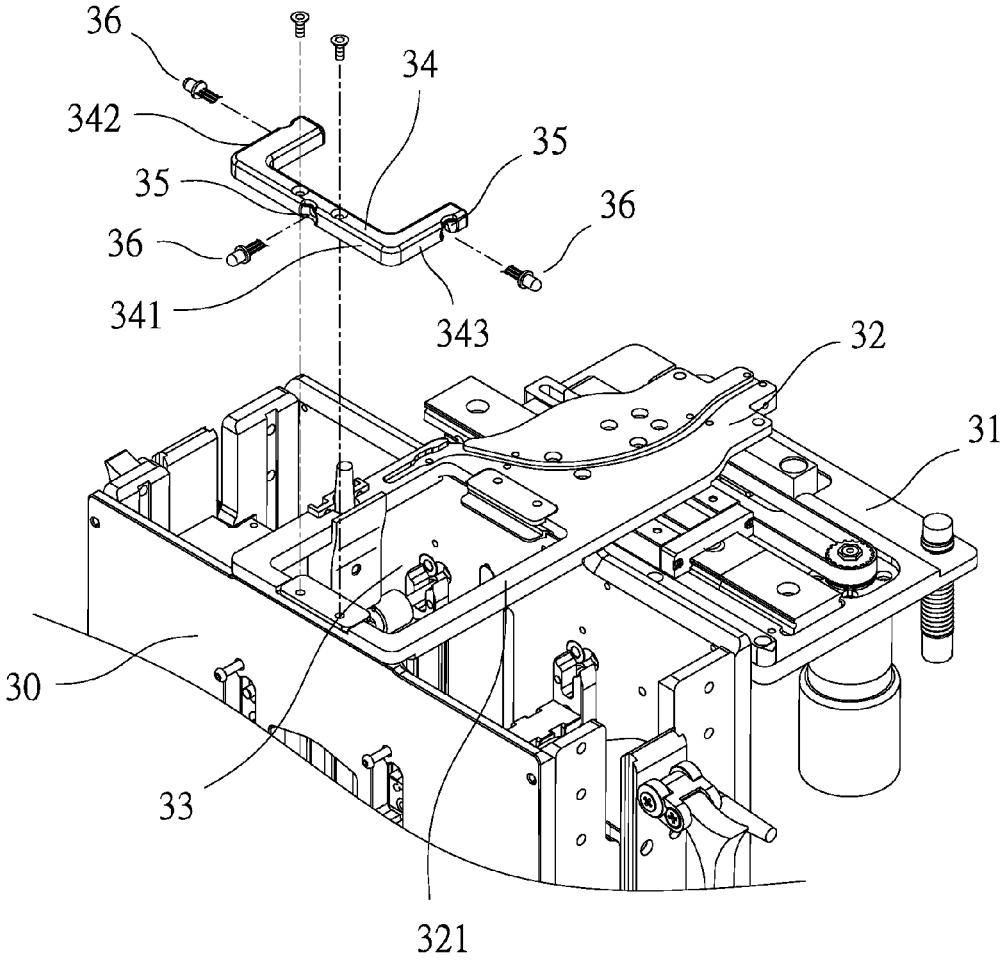
FIG. 2 is an exploded view of the present invention.
Figure 3:
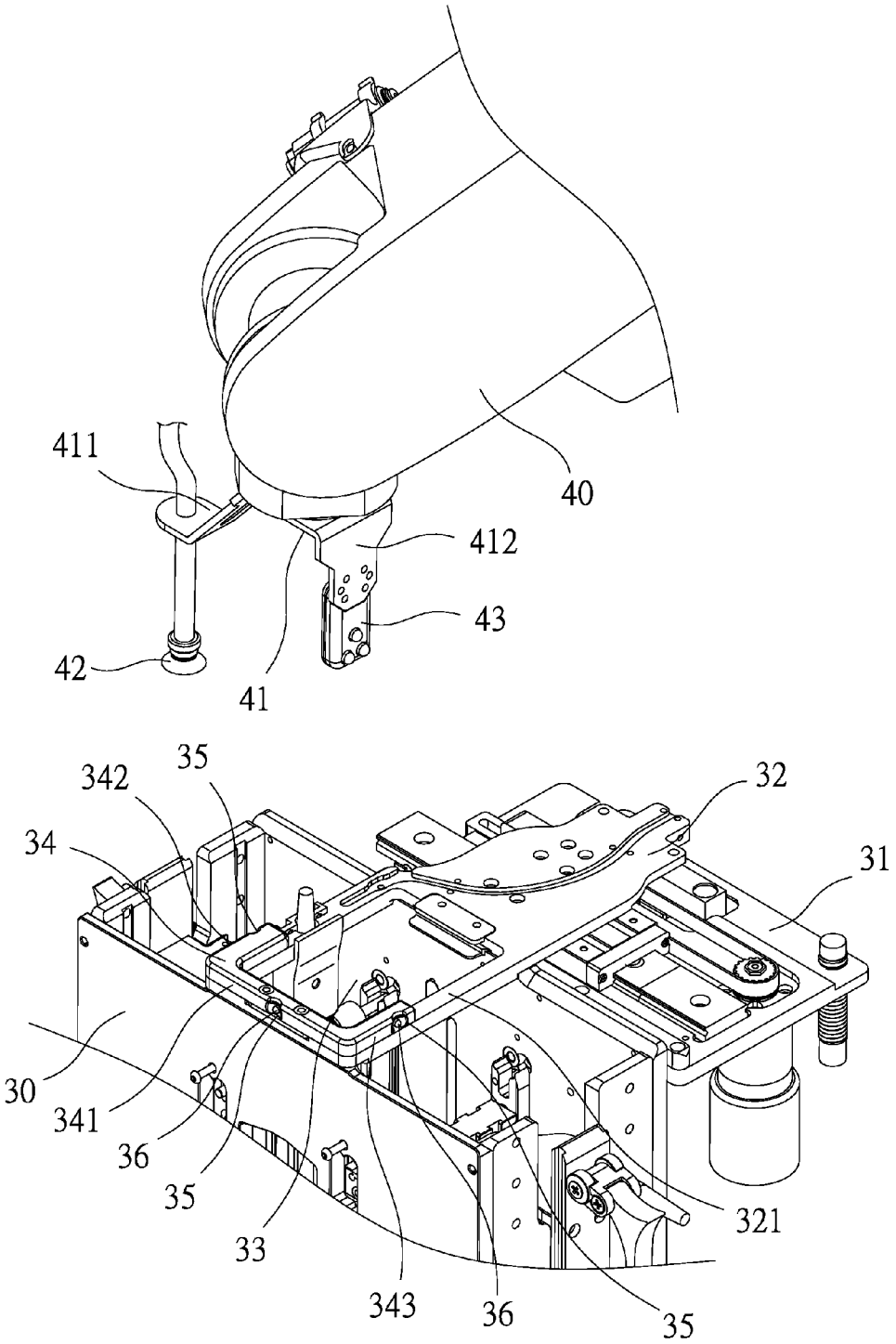
FIG. 3 is a perspective view of the present invention.

As shown in FIG. 2 and FIG. 3, the present invention discloses a playing card game machine. The playing card game machine comprises a shuffling machine 30 and a robotic arm 40. The shuffling machine 30 comprises a drive mechanism 31 to drive a movable board 32 having a through hole 33 to move left and right. The through hole 33 corresponds in shape to a playing card, such that a front end of the movable board 32 is formed with a U-shaped frame 321. The movable board 32 is provided with a sensing seat 34 corresponding in shape to the U-shaped frame 321. The sensing seat 34 is in a U shape and has a front side 341, a left side 342 and a right side 343. Each of the front side 341, the left side 342 and the right side 343 has at least one trumpet-shaped accommodation cavity 35. The cavity 35 is provided with an infrared receiver 36 therein. A distal end of the robotic arm 40 has a coupling seat 41. The coupling seat 41 has a first extension plate 411 and a second extension plate 412. The first extension plate 411 is provided with a suction cup 42. The second extension plate 412 is provided with an infrared transmitter 43. The suction cup 42 of the robotic arm 40 passes through the through hole 33 of the movable board 32 to suck playing cards. Through the aforesaid device, the infrared receivers 36 of the sensing seat 34 can sense an external infrared ray and stop running of the game machine and send a warning signal. This prevents the playing cards from being marked, and the player is unable to know the suit and numeric of the playing card passing through the through hole 33 to bring a fair competition in the game. The infrared transmitter 43 of the coupling seat 41 projects infrared rays to the infrared receivers 36 of the sensing seat 34, achieving a self-check to confirm whether the running of the machine is normal.

The details of the assembly of the present invention are described as below. Referring to FIG. 2 and FIG. 3, the infrared receivers 36 are mounted to the front side 341, the left side 342 and the right side 343 of the sensing seat 34 respectively to sense in three directions whether there is an external infrared ray during the game. The trumpet-shaped accommodation cavity 35 enables the infrared receiver 36 to have a broad receiving angle. The back of the shuffling machine 30 is a lightproof board or a metal board to prevent radiation of infrared rays. Thus, the front and the left and right sides of the sensing seat 34 are able to sense infrared rays, preventing any cheat by means of an infrared video apparatus. During the game, when the infrared receivers 36 of the sensing seat 34 sense improper infrared rays, a warning light or a buzzer will send a warning signal or stop or pause the game. After the obstacle is removed, the players continue to play the game. The present invention can prevent any playing card marked and coated with an infrared reflection material from being read by an infrared video apparatus to result in unfairness in the game, so that the players have more trust in participating the game.

It is noted that as shown in FIG. 2 and FIG. 3 the robotic arm 40 is moved to the sensing seat 34 of the shuffling machine 30 each round of the game and actuates the infrared transmitter 43 to supply infrared rays to the infrared receivers 36 at the front side 341, the left side 342 and the right side 343 of the sensing seat 34 to check whether the infrared receivers 36 can run normally. If the infrared receivers 36 malfunction, the warning light or the buzzer will send a signal to notify the maintenance man of the demand for maintenance or the removal of obstacles.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A playing card game machine with an anti-cheat device, the playing card game machine comprising a shuffling machine and a robotic arm; the shuffling machine comprising a drive mechanism to drive a movable board having a through hole to move left and right, the robotic arm being provided with a suction cup, the suction cup passing through the through hole of the movable board to suck playing cards; the movable board being provided with a sensing seat, a periphery of the sensing seat being provided with infrared receivers arranged in at least three directions.

2. The playing card game machine with an anti-cheat device as claimed in claim 1, wherein the through hole corresponds in shape to the playing cards, a front end of the movable board is formed with a U-shaped frame, the sensing seat has a U shape corresponding to the U-shaped frame, the periphery of the sensing seat has a front side, a left side and a right side, each of the front side, the left side and the right side has at least one accommodation cavity, and the accommodation cavity is provided with one of the infrared receivers therein.

3. The playing card game machine with an anti-cheat device as claimed in claim 2, wherein a distal end of the robotic arm has a coupling seat, the coupling seat has a first extension plate and a second extension plate, the first extension plate is provided with the suction cup, the second extension plate is provided with an infrared transmitter, and the infrared transmitter projects infrared rays to the infrared receivers of the sensing seat.

4. The playing card game machine with an anti-cheat device as claimed in claim 2, wherein the accommodation cavity is a trumpet-shaped opening.

* * * * *